United States Patent [19]

Mahabadi et al.

[11] Patent Number: 4,727,011

[45] Date of Patent: Feb. 23, 1988

[54] PROCESSES FOR ENCAPSULATED TONER COMPOSITIONS WITH INTERFACIAL/FREE-RADICAL POLYMERIZATION

[75] Inventors: Hadi K. Mahabadi, Mississauga; Raj D. Patel, Oakville, both of Canada; Steve W. Webb, Amherst, Mass.; Joseph D. Wright, Burlington, Canada

[73] Assignee: Xerox Corporation, Stamford, Conn.

[21] Appl. No.: 919,411

[22] Filed: Oct. 16, 1986

[51] Int. Cl.[4] ..... G03G 9/08

[52] U.S. Cl. ..... 430/138; 428/403; 428/407

[58] Field of Search ..... 430/137, 138, 110; 428/403, 407

[56] References Cited

U.S. PATENT DOCUMENTS

| | | | |
|---|---|---|---|
| 4,304,843 | 12/1981 | Manger et al. | 430/331 |
| 4,307,169 | 12/1981 | Matkan | 430/111 |
| 4,329,415 | 5/1982 | Ikeda et al. | 430/109 |
| 4,362,802 | 12/1982 | Tanaka et al. | 430/106.6 |
| 4,386,147 | 5/1983 | Seimiya et al. | 430/99 |
| 4,401,742 | 8/1983 | Chiang | 430/137 |
| 4,415,644 | 11/1983 | Tamaki et al. | 430/106.6 |
| 4,514,487 | 4/1985 | Kasuya et al. | 430/137 |
| 4,576,890 | 3/1986 | Hosoi | 430/138 |
| 4,599,289 | 7/1986 | Suematsu et al. | 430/98 |
| 4,608,330 | 8/1986 | Marabella | 430/138 |
| 4,640,709 | 2/1987 | Beestman | 424/32 |

*Primary Examiner*—John L. Goodrow

*Attorney, Agent, or Firm*—E. O. Palazzo

[57] ABSTRACT

An improved process for the preparation of encapsulated toner compositions which comprises mixing in the absence of solvent a core monomer, an initiator, pigment particles, a first shell monomer, stabilizer, and water; thereafter adding a second shell monomer thereby enabling an interfacial polymerization reaction between the first, and second shell monomers; and subsequently affecting a free radical polymerization of the core monomer.

17 Claims, No Drawings

PROCESSES FOR ENCAPSULATED TONER COMPOSITIONS WITH INTERFACIAL/FREE-RADICAL POLYMERIZATION

BACKGROUND OF THE INVENTION

The present invention is generally directed to processes for encapsulated toner compositions, and more specifically the present invention is directed to process for the formulation of encapsulated toner compositions by interfacial polymerization of shell-forming monomers in the presence of a free-radical initiator and monomer(s) contained in the core, and the subsequent free-radical polymerization of the core monomers in the absence of a solvent. Thus, in one embodiment the present invention is directed to a process for the simple, and economical preparation of cold pressure fixable toner compositions by interfacial/free-radical polymerization methods wherein there is selected a polymerizable monomer comprising part or all of the core material in place of an undesirable solvent normally used for such processes. Other embodiments of the present invention relate to interfacial/free-radical polymerization processes for obtaining colored toner compositions in the absence of solvents thus eliminating explosion hazards associated therewith; and furthermore, these processes do not require expensive and hazardous separation and recovery steps. Moreover, with the process of the present invention there is obtained improved yields of toner products since, for example, the extraneous solvent component can be replaced by usuable pigment particles, core monomer(s) or core polymer(s). Additionally, the selection of monomer component for the process of the present invention enables a lower cost of production for the desired toner compositions, greater flexibility in the selection of core material properties, and a higher degree of core and toner physical property control than can be achieved with the polymers and solvents of the prior art. The aforementioned toners prepared in accordance with the process of the present invention are useful for permitting the development of images in electrostatographic imaging systems, inclusive of electrostatic imaging processes wherein pressure fixing, especially pressure fixing in the absence of heat is selected.

Encapsulated and cold pressure fixable toner compositions are known. Cold pressure fixable toners have a number of advantages in comparison to toners that fused by heat, primarily relating to the requirements for less energy since the toner compositions used can be fused at room temperature. Nevertheless, many of the prior art cold pressure fixable toner compositions suffer from a number of deficiencies. For example, these toner compositions must usually be fused under high pressure, which has a tendency to severely disrupt the toner fusing characteristics of the toner selected. This can result in images of low resolution, or no images whatsoever. Also, with some of the prior art cold pressure toner compositions substantial image smearing can result from the high pressures used. Additionally, the cold pressure fixing toner compositions of the prior art have other disadvantages in that, for example, these compositions are prepared with solvents that may create explosion hazards; and further these solvents are costly in that separation and recovery equipment is required. Moreover, the selection of the aforementioned solvents may decrease the percentage yield of toner product obtained; and also these solvents limit flexibility requirements in the selection of the core polymer. Additionally, the use of solvents in the prior art processes prevents, in some instances, obtaining toner particles with particular properties. Furthermore, with many of the prior art processes narrow size dispersity particles cannot easily be achieved by conventional bulk homogenization techniques as contrasted with the process of the present invention wherein interparticle free-radical polymerization of partially shell-polymerized toners can be exploited to narrow the size dispersity of the particles thus formed. In addition, many prior art processes provide delecterious effects on toner particle morphology and bulk density as a result of the removal of solvent and the subsequent collapse of the toner particles during particle isolation, resulting in a toner of very low bulk density, which disadvantages are substantially eliminated with the process of the present invention. More specifically, thus with the process of the present invention control of the toner physical properties of both the core and shell materials is afforded by selecting the conditions of the separate polymerization processes and by providing certain polymerization monomers. In this manner, virtually any molecular weight or viscosity property of core materials can be achieved by the proper selection of core monomer(s) and free-radical polymerization conditions. Additionally, the toner compositions prepared in accordance with the process of the present invention have hard shells thus enabling images of excellent resolution with substantially no background deposits for a number of imaging cycles. Also, the toner compositions prepared in accordance with the process of the present invention have apparent bulk densities as high as 1.2 grams/cc.

With further specific reference to the prior art, there is disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization process are also selected for the preparation of the toners of this patent. Also, there is disclosed in the prior art encapsulated toner compositions containing costly pigments and dyes reference for example the color photocapsule toners of U.S. Pat. Nos. 4,399,209; 4,482,624; 4,483,912 and 4,397,483.

Moreover, illustrated in a copending application U.S. Ser. No. 621,307, the disclosure of which is totally incorporated herein by reference, are single component cold pressure fixable toner compositions, wherein the shell selected can be prepared by an interfacial polymerization process. A similar teaching is present in copending application U.S. Ser. No. 718,676, the disclosure of which is totally incorporated herein by reference. In the aforementioned application, the core can be comprised of magnetite and a polyisobutylene of a specific molecular weight encapsulated in a polymeric shell material generated by an interfacial polymerization process.

Liquid developer compositions are also known, reference for example U.S. Pat. No. 3,806,354, the disclosure of which is totally incorporated herein by reference. This patent illustrates liquid inks comprised of one or more liquid vehicles, colorants such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as polyvinyl pyrrolidone. Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stablizer irreversibly chemically, or physically anchored to the thermoplastic resin core, and a colored dye imbibed in the thermoplastic resin core. The history and evolution of liquid developers is provided in the '210 patent, reference columns 1, and 2 thereof.

Free-radical polymerization is also well known art, and can be generalized as bulk, solution, or suspension polymerization. These polymerizations are commonly used for the manufacture of commodity polymers. The kinetics and mechanisms for free-radical polymerization of monomer(s) is also well known. In these processes the control of polymer properties such as molecular weight and molecular weight dispersity can be effected by initiator, species concentrations, temperatures, and temperature profiles. Similarly, conversion of monomer is effected by the above variables. None of the aforementioned free-radical polymerization prior art, however, discloses the polymerization kinetics in the core of a microencapsulated toner, especially in the presence of pigments or other additives.

Accordingly, there is a need for the preparation of encapsulated toner compositions. Also, there is a need for interfacial polymerization processes for black and colored encapsulated toner compositions, wherein the core contains a polymerizable monomer and free-radical initiator together with pigments and other materials, and wherein solvents are eliminated. There is also a need for simple, economical processes for the preparation of cold pressure fixable toner compositions in high yields, which processes are effected in the absence of solvents. There is also a need for the formulation of cold pressure fixable toner compositions wherein expensive and hazardous solvent recovery is unnecessary. Additionally, there is a need for simple economical polymerization processes that will permit the generation of encapsulated toner compositions, especially compositions with hard, durable shells, excellent toner flowability and high bulk density. Furthermore, there is a need for improved processes that will enable cold pressure fixable toner compositions with hard shells and soft cores, whose properties such as molecular weight, molecular weight dispersity and degree of crosslinking can be independently controlled. Moreover, there is a need for enhanced flexibility in the design and selection of materials comprising the core and shells of toner particles, and the control of the physical properties, such as bulk density, particle size and size dispersity of the toner, which control is achievable with the process of the present invention. With the free-radical core polymerizations, for example, control of bulk physical properties such as melt viscosity are obtained, for example, by the selection of appropriate monomer(s), and initiator types, and concentrations as well as the use of a certain temperature profile. Thus, the fusing performance of the toner may be altered quite simply by a formulation change, independant of the shell polymerization and material, and without effect on toner durability and flow performance.

SUMMARY OF THE INVENTION

It is an object of the present invention to provide processes for encapsulated toner compositions which overcome the above-noted disadvantages.

In another object of the present invention there are provided simple, and economical processes for black, and colored toner compositions formulated by an interfacial/free-radical polymerization process in which the shell formation (interfacial polymerization), core formation (free-radical polymerization), and resulting material properties, are independently controlled.

In another object of the present invention there are provided simple, and economical processes for black, and colored cold pressure fixable toner compositions formulated by an interfacial/free-radical polymerization process in which the shell formation (interfacial polymerization), core formation (free-radical polymerization), and resulting material properties are independently controlled.

Another object of the present invention resides in simple, and economical processes for black, and colored cold pressure fixable toner compositions with hard shells formulated by an interfacial/free-radical polymerization process.

Moreover, in a further object of the present invention there are provided processes for cold pressure fixable toner compositions wherein solvents are replaced with a free-radical polymerizable monomer.

Further, an additional object of the present invention resides in economical processes for the preparation of encapsulated toners by interfacial/free-radical polymerization processes wherein high yields of product are obtained since there are selected in place of the solvents utilized in the prior art processes polymerizable monomer components.

Additionally, in a further object of the present invention there are provided economical processes for the preparation of encapsulated toners wherein solvent recovery apparatuses are avoided.

Another object of the present invention resides in processes for toner compositions wherein the bulk density is high, for example about 1.2.

An additional object of the present invention resides in the provision of improved flexibility in the control and design of toner materials in that virtually any core material property can be attainable by simple formulation modifications.

Additionally, in another object of the present invention there are provided, as a result of the enhanced degree of control and flexibility afforded with the process of this invention, opportunities for toner fusing property improvements, such as fix, gloss and copy quality by controlling the free-radical polymerization; and toner physical properties, such as bulk density, flow and morphology by the control of the interfacial step-growth polymerization.

These and other objects of the present invention are accomplished by the provision of processes for encapsulated toner compositions comprised of a core containing a pigment particle(s), and a free-radical polymerized monomer(s) with an optional polymer, such as polyisobutylene, in an amount of from about 1 to about 5 percent by weight and a shell generated by interfacial polymerization processes. More specifically, the process of the present invention, which is accomplished in the absence of a solvent, is comprised of (1) mixing a blend of a core monomer, or monomers not exceeding five, free-radical chemical initiator, pigment, and a first shell monomer; (2) forming an organic liquid:solid suspension, in a stabilized aqueous suspension; (3) thereafter forming a liquid suspension; and (4) subsequently subjecting the aforementioned mixture to an interfacial polymerization by the addition of a water-soluble second shell monomer. After the polymerization is complete, a free-radical polymerization is initiated by increasing the temperature of the suspension, for example, to 75 degrees Centigrade, and thus commencing the disassociation of the chemical initiator to free-radicals capable of polymerizing the core monomer(s). Moreover, for obtaining particles with narrow size distributions, that is toner particles with an average diameter of from about 10 to about 35 microns, and geometric size dispersities of less than 1.20, subsequent to the interfacial polymerization step the toner product can be submitted to a free-radical polymerization, permitting the particles to agglomerate and polymerize together through partially formed shells. These partially formed shells are produced by reducing the degree of homogeneity of the original blend of shell material thus biasing the distribution of shell material in favor of larger particles, and promoting interparticle polymerization and growth of smaller particles resulting in a narrowing of the size distribution.

Also, the process of the present invention is directed to the preparation of encapsulated toner compositions which comprises mixing in the absence of solvent a core monomer, an initiator, pigment particles, a first shell monomer, stabilizer and water; thereafter adding a second shell monomer thereby enabling an interfacial polymerization reaction between the first, and second shell monomers; and subsequently affecting a free radical polymerization of the core monomer.

Further, in accordance with the present invention there are provided processes for black and colored cold pressure fixable toner compositions obtained in the absence of a solvent, which process comprises mixing with from about 45 to about 55 percent by weight of water; from about 25 to about 45 percent by weight of a core monomer(s) such as butyl acrylate, lauryl methacrylate, hexyl methacrylate, propyl acrylate, benzyl acrylate, pentyl acrylate, hexyl acrylate, cyclohexyl acrylate, dodecyl acrylate, ethoxy propyl acrylate, heptyl acrylate, isobutyl acrylate, methyl butyl acrylate, m-tolyl acrylate, dodecyl styrene, hexyl methyl styrene, nonyl styrene, tetradecyl styrene, or other substantially equivalent vinyl monomers; and combinations of vinyl monomers with an azo type free-radical initiator such as azoisobutyronitrile, azodimethylvaleronitrile, azobiscyclohexanenitrile, 2-methylbutyronitrile or any combination of azo initiators; and pigment particles, including colored pigments, in an amount of from about 50 to about 70 percent by weight such as magnetites, colored magnetites, carbon blacks, other solid inert materials of particle size of 1 to 5 microns; and a shell comonomer, such as toluene diisocyanate, sebacoyl chloride, adipic acid, toluene bischloroformate, hexanedisulfonic acid, and a shell crosslinking agent such Desmodur RF (Bayer); and subsequently by addition of a water soluble shell comonomer such as diethylene triamine, hexane diamine, hexmethylenediamine, bisphenol A or any other water soluble copolycondensation coreactant to the suspension, accomplishing an interfacial polymerization at the interface of the aforementioned mixture: and thereafter affecting a free radical polymerization by heating the suspension and allowing the dissociation of chemical initiator to free-radicals and initiation of free-radical polymerization by the reaction with core monomer(s).

Accordingly, in one specific important embodiment of the present invention there is provided an improved process for the preparation of encapsulated toner compositions which comprises mixing in the absence of solvent a core monomer, an initiator, pigment particles, a first shell monomer, stabilizer, and water; subjecting the resulting mixture to an interfacial polymerization reaction by adding a second shell monomer; subsequently affecting a free radical polymerization by, for example, inducing initiator decomposition in the core, which decomposition can be enabled with heating, for example, from about 75 to about 95 degree Centigrade.

Illustrative examples of core monomers present in an amount of from about 10 to about 70 percent by weight include acrylates, methacrylates, diolefins, and the like. Specific examples of core monomers are butyl acrylate, butyl methacrylate, lauryl methacrylate, hexyl methacrylate, hexyl acrylate, styrene, cyclohexyl acrylate, dodecyl acrylate, ethoxy propyl acrylate, heptyl acrylate, isobutyl acrylate, methyl butyl acrylate, m-tolyl acrylate, dodecyl styrene, hexyl methyl styrene, nonyl styrene, tetradecyl styrene, other known vinyl monomers, reference for example U.S. Pat. No. 4,298,672, the disclosure of which is totally incorporated herein by reference, mixtures thereof; and the like.

Illustrative examples of free-radical initiators include azo compounds such as 2-2'azodimethylvaleronitrile, 2-2'azoisobutyronitrile, and other similar known compounds, with the ratio of core monomer to initiator being from about 100/2 to about 100/10. Stabilizers selected for the process of the present invention include polymeric water soluble molecules of high molecular weight of, for example, a number average of from about 20,000 to about 90,000 such as polyvinylalcohols with a stabilizer to water ratio of from about 0.05 to about 0.75 for example.

Various known pigments, present in an amount of from about 5 to about 75 percent by weight, can be selected inclusive of carbon black, magnetites, such as Mapico Black, Mobay MO8029, MO8060, Columbia Pigments magnetite, Pfizer magnetites and other equivalent black pigments. As colored pigments there can be selected Heliogen Blue L6900 from Paul Uhlich & Co. Inc., Pigment Violet 1, Pigment Red 48, Lemon Chrome Yellow DCC 1026, E.D. Toluidine Red and Bon Red C from Dominion Color Corp. Ltd., Toronto, Ont., NOVAperm Yellow FGL, Hostaperm Pink E from Hoechst, Cinquasia Magenta from E.L Dupont de Nemours & Co., Oil Red 2144 from Passaic Color and Chemical. Further, useful colored pigments that can be used are cyan, magenta, or yellow pigments, and mixtures thereof. Examples of magenta materials that may be selected as pigments include, for example, 2,9-dimethyl-substituted quinacridone and anthraquinone dye identified in the color index as Cl 60710, Cl Dispersed Red 15, diazo dye identified in the color index as Cl 26050, Cl Solvent Red 19, and the like. Illustrative examples of cyan materials that may be used as pigments include copper tetra-4(octadecyl sulfonamido)

phthalocyanine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected are diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33 2,5-dimethoxy-4-sulfonanilide phenylazo-4'-chloro-2,5-dimethoxy aceto-acetanilide, and Permanent Yellow FGL. The aforementioned pigments are incorporated into the encapsulated toner compositions in various suitable effective amounts providing the objectives of the present invention are achieved. In one embodiment, these colored pigment particles are present in the toner composition in an amount of from about 2 percent by weight to about 15 percent by weight calculated on the weight of the dry toner. Colored magnetites, such as mixtures of Mapico Black, and cyan components may also be used as pigments with the process of the present invention.

Examples of shell polymers resulting from the reaction of the first shell monomer, and the second shell monomer, each present in an amount of from about 2.5 to about 12.5 percent by weight, for example, are polyureas, polyamides, polyesters, polyurethanes, and the like. The second shell monomer includes water soluble amines, especially secondary amines; and the first shell monomer includes organic soluble isocyanates, including dimeric and trimeric isocyanates, toluene diisocyanate, sebacoyl chloride, or terephlaloyl chloride. The first and second shell amounts are generally 5 to 25 percent by weight of the toner, and with a thickness generally less than about 2 microns. The aforementioned shell polymers are generally present in an amount of from about 5 to about 25 percent by weight of the toner, and further the thickness of the shell is usually less than about 2 microns. Other shell polymers, shell amounts, and thicknesses can be selected provided the objectives of the present invention are achievable. Moreover, in accordance with the process of the present invention there may be added and mixed with the core monomers, for purposes of core material property control and enhancement, polymers such as styrene-butadienes, polyvinylethers, polybutadienes, and polysiloxanes, or core crosslinking agents such as divinylbenzene, core plasticizers such as dioctyladipate or pentaerythritol tetrabenzoates.

Interfacial processes selected for the shell formation are as illustrated, for example, in U.S. Pat. Nos. 4,000,087 and 4,307,169, the disclosures of which are totally incorporated herein by reference.

The following examples are being submitted to further define various species of the present invention. These examples are intended to be illustrative only and are not intended to limit the scope of the present invention. Also, parts and percentages are by weight unless otherwise indicated.

EXAMPLE I

Single Monomer Core

To 300 grams of magnetite (Pfizer), a magnetic pigment was added 118 grams of washed n-laurylmethacrylate monomer (LMA inhibited by 100 ppm (parts per million) of hydroquinone, Polysciences), 2.1 grams of azoisobutyronitrile catalyst (AIBN, Polysciences), 2.1 grams of azodimethylvaleronitrile catalyst (VAZO-52, Dupont), 36 grams of toluene diisocyanate (TDI, Olin TDI-80), and 18 grams of Desmodor RF (DRF, Bayer) in a two liter vessel. The laurylmethacrylate monomer was washed 4 times with separation, first with 2 liters of a 1 percent sodium bicarbonate, and finally with 2 liters of water. Washing was accomplished to remove the inhibitor (100 ppm hydroquinone) and to remove any residual water soluble acid remaining (0.005 percent methacrylic acid). The mixture was then homogenized by high shear blending at 10,000 RPM with a Brinkmann 45 millimeters homogenizing probe for 3 minutes at room temperature. To the mixture resulting there was added 1 liter of 0.05 percent polyvinylalcohol (PVOH, nominal molecular weight 96,000, 88 percent hydrolyzed, Scientific Products) solution; and thereafter the two phases resulting were homogenized by high shear blending at 10,000 RPM for 3 minutes. The particles formed were of average size of 26 microns. Subsequently, the resulting suspension was mixed at 300 RPM with conventional stirring for 30 minutes after which 24 grams of diethylenetriamine (DETA, Aldrich) in 100 grams of water was added. This suspension was stirred at room temperature for 2 hours, followed by heating at 1 degree Centigrade/minute to 76 degrees Centigrade for core polymerization, and held at 76 degrees Centigrade for 6 hours. When all the core monomer(s) had been converted to polymer, the suspension was cooled and washed by dilution with excess water four times, decanting each time the toner product obtained over a magnet. To the washed toner was added 20 grams of colloidal graphite ("Aquadag", Acheson Colloids). The final suspension was then spray dried at 150 degrees Centigrade air inlet, and 60 to 80 degrees Centigrade air outlet temperature.

The recovered dry toner, with an average size diameter of 27 microns, was blended by mechanical shaking with 0.15 percent of Aerosil R974 (Degussa) flow agent for the purpose of improving the bulk flow of the toner particles, and 0.5 percent of zinc stearate (Fisher U.S. Patent) release agent for the purpose of improving the blocking ability of the toner in a printing machine. The toner was then sieved through a 90 micron sieve to remove agglomerated flow agent, and tested in a cold pressure fix printing device. Print quality showed a fix of 50 to 60 percent optical density retained after the known tape pull test; the initial OD being 1.5 to 1.6 with no background or offset/smearing.

The cold pressure fix printing machine used in the testing of the aforementioned toners, and the other toners illustrated herein was the Delphax S-6000 ionographic development, cold pressure fix printer. The images developed were fused at 55 degrees Celsius and 1300 to 1500 pounds per square inch pressure.

Print quality was evaluated from a checkerboard print pattern after 50 to 100 copies. Fix was measured from a standardized tape pull method in which the optical density before and after the tape was adhered and removed from the surface of the print, was compared, and the value reported as percent optical density remaining. Optical density was measured using a standard integrating densitometer. Smearing and offset were evaluated qualitatively by rubbing with a blank paper surface, the surface of the fused checkerboard print with a standard force and cycle time, and viewing the surface cleanliness of non-printed and printed areas of the page. Particle size was measured using a 14 channel Coulter Counter.

EXAMPLE II

Core Polymer and Monomer(s)

To 240 grams of magnetite was added a solution of 26 grams styrene monomer (Kodak, inhibited with 10 to 20 ppm tertiarybutylcatechol), 49 grams n-butylmethacrylate monomer (NBMA, Aldrich, inhibited with 100 ppm hydroquinone), 7.9 grams of azoisobutyronitrile (AIBN, Polysciences), 48 grams of polyisobutylene (PIB, nominal molecular weight 8500, Esso Chemical), 10 grams Desmoder RF (DRF), and 23 grams of toluene diisocyanate (TDI) in a two liter vessel. The mixture was blended at 4,800 RPM for 3 minutes. To this dispersion was added 1 liter of 0.06 percent PVOH solution. The resulting mixture was then dispersed at 4,000 RPM for 3 minutes, and the resulting particle size diameter was 11 microns with a GSD of 2.0. To this particle suspension was then added 10 grams of diethylenetriamine (DETA), in 100 grams of water, and the suspension was stirred at 100 to 200 RPM and room temperature for 2 hours. The temperature was then raised 1 degree Centigrade/minute to 76 degrees Centigrade and kept at 76 degrees Centigrade for 5 hours to allow core polymerization and particle growth. The resulting toner particles were then washed and dried as in Example I. To the dry toner, of an average diameter particle size of 24.6 microns, and a GSD of 1.26, was dry blended by mechanical shaking 6.1 grams of Vulcan XC72R carbon black for toner conductivity development and 2.5 grams of zinc stearate for release requirements. The resulting toner was machine tested and evaluated as in Example I yielding a fix of 30 to 40 percent OD retained, print optical density of 1.4 to 1.5, no background, and with minor offset and smear.

EXAMPLE III

Core Terpolymer

To 243 grams of magnetite was added, in a two liter vessel, a solution of the following: 48 grams of styrene monomer, 55 grams of n-butylmethacrylate monomer, 32 grams of n-laurylmethacrylate monomer (LMA, washed as in Example I), and 8.0 grams of AIBN, along with 19 grams of TDI and 11 grams of DRF. The resulting mixture was then homogenized by high shear blending as in Example I. To this suspension was added 1 liter of a 0.10 percent PVOH, and the mixture was then homogenized by repeating the procedure of Example I yielding a product with a particle size of 14 microns and GSD of 1.53. Using the identical heating and stirring procedure as in Example I, and with the addition of 9 grams of diethylenetriamine, DETA, the polymerizations were effected to completion. The final particle diameter size of the toner was 22.8 microns with a GSD of 1.26. The toner suspension was then washed and treated by repeating the appropriate steps of Example I. To the recovered dry toner was dry blended by mechanical shaking 1.78 percent XC72R carbon black and 1.0 percent zinc stearate as in Example II. The toner was then sieved and machine tested by repeating the procedure of Example I yielding a fixability of 30 to 40 percent OD retained, no background, print optical density of 1.4 to 1.5 with no smearing or offset noticed.

EXAMPLE IV

Core Crosslinker

To 240 grams of magnetite was added, in a two liter vessel, a solution containing 30 grams of styrene monomer, 54 grams of n-butylmethacrylate monomer, 46.8 grams of polyisobutylene (nominal molecular weight of 2,700), 0.07 gram of divinylbenzene as a crosslinking agent, and 7.4 grams of AIBN, with 20 grams of toluene diisocyanate (TDI), and 11 grams of DRF. Using the identical procedure as in Example III, with the addition of 12 grams of DETA, a toner of average size of 25 microns, and GSD of 1.28 was produced. This toner was then blended by repeating the procedure in Example III; and was machine tested in accordance with Example I yielding an adequate fix of 20 to 30 percent, a print optical density of 1.4, with no background, offset or smearing.

EXAMPLE V

Core Plasticizer

To 240 grams of magnetite was added, in a two liter vessel, a solution containing 30 grams of styrene monomer, 27 grams of n-butylmethacrylate monomer, 41 grams of polyisobutylene (nominal molecular weight of 2,700), 5 grams of pentaerythritol benzoate plasticizer, and 7.2 grams of AIBN with 13 grams of TDI and 7 grams of DRF. The procedure of mixing, stirring, polymerization, and dry blending was repeated in accordance with Example III. The final particle size of the dried toner was 22.5 microns with GSD of 1.36. This toner thus produced had a fix of 30 to 40 percent, print optical density of 1.5 to 1.6, with no background, smearing or offset.

EXAMPLE VI

Core Comonomer

To 285 grams of magnetite pigment was added a solution comprising 28 grams of styrene monomer, 104 grams of n-laurylmethacrylate monomer, and 8.5 grams of AIBN with 36 grams TDI and 18 grams of DRF. The mixture was dispersed at 4,000 RPM for 3 minutes using the identical equipment as resulted in Example I. To this mixture was added 1 liter of 0.10 percent polyvinylalcohol soap solution. The two phases were then dispersed at 10,000 RPM for 3 minutes generating particles of 18 microns average size. The toner suspension was then stirred at 300 RPM with conventional mixing for 30 minutes after which 25 grams of DETA in 100 grams of water were added. The suspension was then left for 2 hours to complete the shell polycondensation. The suspension was then heated at 1 degree Centigrade/minute to 80 degrees Centigrade, and left at 80 degrees Centigrade for 5 hours to complete the core polymerization. The toner produced of 18 micron average size, was then dried and blended in the identical manner as the toner of Example I. The machine test demonstrated a fix of 50 to 60 percent, print optical density of 1.5 to 1.6, with no background, smearing or offset.

EXAMPLE VII

Core Magnetite

To 300 grams of Mobay Bayferrox 8600 magnetite was added a solution of 118 grams laurylmethacrylate monomer. 2.2 grams of AIBN and 2.1 grams of VAZO, with 36 grams of TDI and 18 grams of DRF. The above mixture was blended at 10,000 RPM for 1 minute using the equipment described in Example I. To this blend was added 1 liter of 0.05 percent polyvinylalcohol solution. The two phases were then blended at 10,000 RPM for 3 minutes. The toner suspension was then treated identically to that as described in Example I. The recovered and blended toner was machine tested and found to give adequate print quality and fix, with fix of 50 to 60 percent, print optical density of 1.5 to 1.6, no background with minor offset and smearing.

EXAMPLE VIII

Shell Thickness

There was prepared a toner composition by repeating the procedure of Example I with the exception that there were selected 43 grams of the TDI shell material; DRF, 19 grams; and DETA, 28 grams, thus producing a thicker shell. The toner produced was machine tested and found to maintain a good fix of 10 to 20 percent, print optical density of 1.3 to 1.4, with no smearing or offset or background.

EXAMPLE IX

Core Initiator

There was prepared a toner composition by repeating the procedure of Example I with the exception that that there was selected as the core initiator 3.2 grams of azodimethylvaleronitrile (VAZO-52, DuPont) alone without AIBN. The toner thus produced was also machine tested and found to yield a very good fix of 40 to 50 percent, print optical density of 1.5 to 1.6, with no background, smearing or offset.

EXAMPLE X

Carbon Black

The identical formulation and method as in Example I was used except that to the core was added 6 grams of Cabot Vulcan XC72R carbon black. The same blending and polymerization procedures were used as described in Example I. The toner thus produced was washed by dillution with excess water and vacuum filtered to a cake comprising approximately 80 percent solids. The toner cake was then dried in a vacuum oven at 76 degrees Centigrade for 5 hours. To the dried toner was added 2 percent additional XC72R carbon black which was blended by high shear mixing in a tumbler. Also added, in a similar manner, was 1.3 percent zinc stearate and 0.05 percent Aerosil flow agent (R972). The toner was then tested for fusing and flow performance by repeating the procedure of Example I, and found to be adequate with fix performance of 30 to 40 percent, print optical density of 1.5 to 1.6, with no smearing offset or background.

EXAMPLE XI

Particle Size Control

Using the same process as described in Example I, control of particle size is exercised by varying the solids fraction in the suspension, solids to stabilizer ratio, and degree of shear. Thus, there was prepared a toner by admixing 75 grams of styrene dissolved with 5.1 grams of AIBN initiator and 47 grams of polyisobutylene (nominal molecular weight of 1,350, Polysciences), to which was further added and dissolved at 100 to 200 RPM shear, 9 grams of DRF crosslinker and 22.3 grams of TDI. To this solution was blended 165 grams of magnetite pigment by high shear (10,000 RPM) for 3 minutes with a 45 millimeters Brinkmann probe, as described in Example I. This organic phase was then added to a 1 liter solution of 0.625 percent PVOH (described in Example I) and sheared for 3 minutes at 10,000 RPM with the same mixing probe. The initial particle size was 8.9 microns with 1.4 geometric size dispersity. To this suspension of toner particles was added 15 grams of DETA (as in Example I). The polymerizations were then accomplished as described in Example I. The final particle size was 12 microns with 1.35 GSD. The toner thus tested was found to provide a reduced fix of 10 to 20 percent, good optical density of 1.5 to 1.6 with no background, smearing or offset.

EXAMPLE XII

Particle Size Growth:

A toner was prepared by controlled aggolmeration using the following procedure. An organic phase comprising 42 grams of styrene monomer, 23 grams n-butylmethacrylate monomer, 8 grams of AIBN initiator, 13 grams of polyisobutylene (mol. wt. 1,350), 11 grams of DRF, 22 grams of TDI and 200 grams of magnetite pigment blended in the same manner as described in Example I, except that 4,800 RPM were used instead of 10,000. Similarly, the organic phase thus prepared was added to 1 liter of 0.06 percent solution of PVOH and sheared for 3 minutes at 4,800 RPM. The initial particle size was 12 microns with 1.9 GSD. After carrying out the polymerizations identically as described in Example I, the final particle size was 20.6 microns with GSD of 1.21. The toner tested also demonstrated adequate fix, flow and optical density.

Other modifications of the present invention may occur to those skilled in the art based upon a reading of the present disclosure, and these modifications are intended to be included within the scope of the present invention.

What is claimed is:

1. An improved process for the preparation of encapsulated toner compositions which comprise mixing in the absence of solvent a core monomer, an initiator, pigment particles, a first shell monomer thereby stabilizer, and water; thereafter adding a second shell monomer thereby enabling an interfacial polymerization reaction between the first, and second shell monomers; and subsequently affecting a free radical polymerization of the core monomer.

2. A process in accordance with claim 1 wherein the core monomers are selected in an amount of 40 to 70 percent, sheel monomers (polymer) of 5 to 30 percent, and pigment of 10 to 75 percent.

3. A process in accordance with claim 1 wherein the free radical polymerization is accomplished by inducing initiator decomposition in the core by heating.

4. A process in accordance with claim 1 wherein the core monomer is selected from the group consisting of alkyl acrylates, and alkyl methacrylates, styrene and styrene derivatives, such as butyl acrylate, lauryl methacrylate, hexyl methacrylate, propyl acrylate, benzyl acrylate, pentyl acrylate, heptyl acrylate, isobutyl acrylate, methyl butyl acrylate, m-tolyl acrylate, dodecyl styrene, hexyl methyl styrene, nonyl styrene tetradecyl styrene, or any other effective vinyl monomers, or any combination of vinyl monomers and mixtures there of which are capable of free-radical addition polymerization.

5. A process in accordance with claim 1 wherein the initiator is an azo compound.

6. A process in accordance with claim 1 wherein the pigment particles are selected from the group consisting of carbon black, magnetites, and colored components.

7. A process in accordance with claim 1 wherein the shell is a crosslinked or uncrosslinked polyurea, polyester, polyurethane or polyamide polymer formed in the presence of free-radical initiator; and core monomer(s) by the product of a step-growth reaction of an organic phase soluble comonomer; and a crosslinker; and water phase soluble comonomer.

8. A process in accordance with claim 1 wherein the interfacial polymerization is accomplished by the step-growth polymerization reaction of a water soluble shell comonomer present in the aqueous phase; and an organic soluble shell comonomer present in the particle phase in the presence of a free-radical initiator and core monomer.

9. A process in accordance with claim 1 wherein the free radical polymerization is accomplished, after an interfacial shell polymerization, by thermal decomposition of a core-resident free-radical chemical initiator, and subsequent reaction and addition polymerization with a core-resident vinyl monomer in the presence of pigments.

10. A process in accordance with claim 1 wherein the particle size is controlled and size dispersity is narrowed by agglomeration of partially covered particles generated from intentional maldistribution of shell material, and resultant particle growth by interparticle free-radical polymerization at elevated temperatures during core polymerization.

11. A process in accordance with claim 8 wherein the colorants are selected from the group consisting of magnetite particles, carbon blacks, or colored pigments or dyes.

12. A process in accordance with claim 1 wherein the core monomer is comprised of up to five monomers.

13. A process in accordance with claim 1 wherein a flow additive and zinc stearate are mixed with the core monomer, the initiator, the pigment particles, the first shell monomer, the stabilizer, and the water.

14. A process in accordance with claim 13 wherein the flow additive is Aerosil ®R972.

15. A process in accordance with claim 3 wherein the free radical polymerization is accomplished by heating to a temperature between 75° and 95° C.

16. A process in accordance with claim 5 wherein the azo compound is selected from the group consisting of 2,2′-azodimethylvaleronitrile and 2,2′-azoisobutyronitrile.

17. A process in accordance with claim 7 wherein the crosslinker is divinylbenzene.

* * * * *